US008344648B2

(12) United States Patent
Straub

(10) Patent No.: US 8,344,648 B2
(45) Date of Patent: Jan. 1, 2013

(54) ELECTRICAL DEVICE, IN PARTICULAR AN ELECTRIC POWER TOOL OR AN ELECTRICAL APPLIANCE

(75) Inventor: Christian Straub, Schaffhausen (CH)

(73) Assignee: Marquardt GmbH, Rietheim-Weilheim (DE)

( * ) Notice: Subject to any disclaimer, the term of this patent is extended or adjusted under 35 U.S.C. 154(b) by 520 days.

(21) Appl. No.: 12/366,775

(22) Filed: Feb. 6, 2009

(65) Prior Publication Data

US 2009/0200961 A1 Aug. 13, 2009

(30) Foreign Application Priority Data

Feb. 9, 2008 (DE) ..... 10 2008 008 434

(51) Int. Cl.
*G05F 1/10* (2006.01)
*B25B 23/18* (2006.01)

(52) U.S. Cl. ..... 315/291; 315/314; 362/119

(58) Field of Classification Search ..... 315/291, 315/314; 362/119; 408/4; 439/628; 173/217, 173/170

See application file for complete search history.

(56) References Cited

U.S. PATENT DOCUMENTS

| | | | | |
|---|---|---|---|---|
| 6,502,949 | B1 * | 1/2003 | Horiyama et al. | 362/119 |
| 2003/0096158 | A1 * | 5/2003 | Takano et al. | 429/90 |
| 2005/0121209 | A1 * | 6/2005 | Shimizu et al. | 173/217 |
| 2008/0311795 | A1 * | 12/2008 | Brotto et al. | 439/628 |

FOREIGN PATENT DOCUMENTS

| | | |
|---|---|---|
| DE | 43 27 767 | 11/1994 |
| DE | 197 51 182 | 5/1999 |
| DE | 202 15 382 | 4/2003 |
| DE | 602 15 595 | 8/2007 |

* cited by examiner

*Primary Examiner* — Daniel D Chang

(74) *Attorney, Agent, or Firm* — Burr & Brown

(57) ABSTRACT

An electric appliance having a main electric load, an auxiliary electric load, and a voltage supply for operating both electric loads. An auxiliary voltage is generated by the voltage supply and supplied to the auxiliary electric load at a constant level so that the power of the auxiliary electric load remains substantially the same irrespective of voltage fluctuations in the voltage supply.

17 Claims, 1 Drawing Sheet

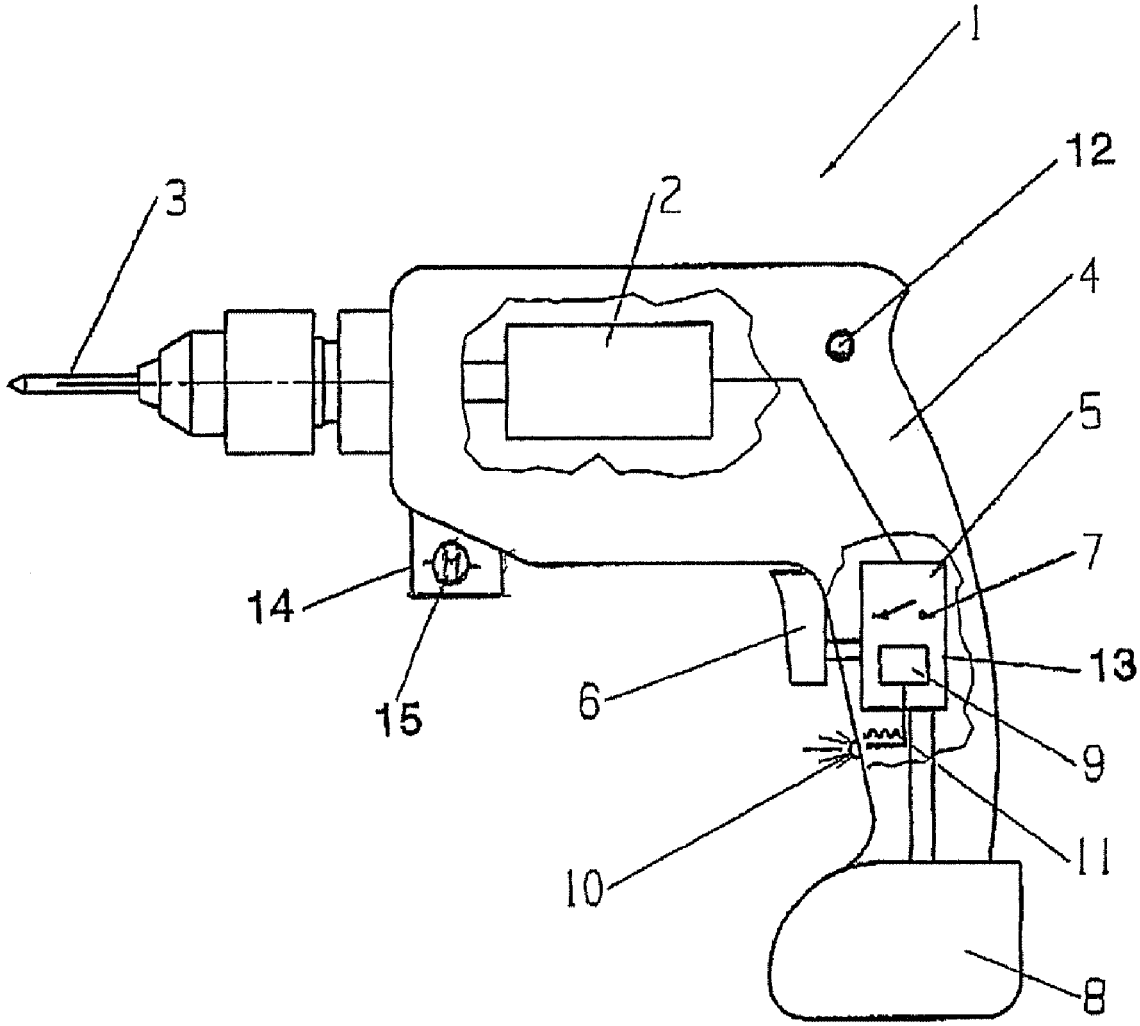
1
12
3
2
4
5
7
14
13
15
6
9
11
10
8

ELECTRICAL DEVICE, IN PARTICULAR AN ELECTRIC POWER TOOL OR AN ELECTRICAL APPLIANCE

FIELD OF THE INVENTION

The invention relates to an electric appliance that is supplied with a constant auxiliary voltage from a voltage supply irrespective of voltage fluctuations in the voltage supply.

The electric appliance may be a handheld power tool, specifically a rechargeable battery-powered and/or plug-powered power tool, in particular drills, grinders, saws, planes, angle grinders or the like. The electric appliance may also be a domestic appliance, such as a kitchen appliance, a vacuum cleaner or the like, or a portable lamp.

BACKGROUND OF THE INVENTION

Power tools of this type have an electric motor (i.e., a main electric load). In the case of handheld power tools, the operating area is often illuminated by a suitable lighting mechanism, for example a suitable light-emitting diode (LED) (i.e., an auxiliary electric load). An operating area illumination mechanism of this type, which can be provided not only in a power tool but also in any other electric appliance, makes it easier or possible to operate with minimal external illumination and/or in unilluminated regions. The power for the electric motor and the power for the operating area illumination mechanism are ultimately provided from the same voltage supply such as a rechargeable battery. The brightness of the operating area illumination mechanism will decrease as the level of charge in the rechargeable battery decreases.

SUMMARY OF THE INVENTION

The invention is based on the object of designing the power tool and/or the electric appliance in such a way that fluctuations during operation of the auxiliary electric load are largely prevented. A particular object is for the brightness of the operating area illumination mechanism to remain constant irrespective of fluctuations in the main voltage supply for the appliance. Another particular object is to find a very simple solution to the described problem.

The electric appliance according to the invention has a main electric load, an auxiliary electric load, and a voltage supply for operation of the main electric load and the auxiliary electric load. The auxiliary voltage generated by the voltage supply and supplied to the auxiliary electric load is kept constant so that the power of the auxiliary electric load remains substantially the same irrespective of voltage fluctuations in the voltage supply. Therefore, the auxiliary electric load in the electric appliance is advantageously controlled independently of the electrical status of the voltage supply. As a result, stable operation of the auxiliary electric load is achieved without substantial fluctuations occurring, and this improves ergonomics for the user.

The invention can be used in an extremely wide variety of electric appliances, in particular those with an auxiliary electric load for exercising an additional function. Therefore, the electric appliance may be a power tool with an electric motor, such as a rechargeable battery-powered and/or plug-powered power tool, for example drills, grinders, saws, planes, angle grinders or the like. Furthermore, the electric appliance may be a domestic appliance with an electric motor, or may be a portable lamp.

In a further refinement, the auxiliary electric load comprises an operating area illumination mechanism by means of which the user of the respective electric appliance can illuminate the region to be treated. In addition to the actual function exercised by the electric appliance, for example drilling by means of an electric drill, the electric appliance also permits the additional function of illuminating the operating area, that is to say illuminating the drilling point in the case of an electric drill for example. The auxiliary voltage supplied to the operating area illumination mechanism is kept constant, so that the brightness of the operating area illumination mechanism remains substantially the same irrespective of fluctuations in the voltage supply. Therefore, the brightness of the operating area illumination mechanism of the electric appliance is advantageously controlled independently of the voltage supply, and this improves ergonomics for the user when using the electric appliance.

Another additional function exercised by the electric appliance may be that the waste material which is produced during use of the electric appliance is removed from the operating region by suction. To this end, the auxiliary electric load comprises a suction-removal mechanism for the operating area, which suction-removal mechanism operates by means of an auxiliary electric motor. If the electric appliance is a drill for example, the auxiliary electric load in the drill, which exercises this additional function, comprises a drill dust suction-removal mechanism which is operated by means of the auxiliary electric motor. The auxiliary voltage supplied to the auxiliary electric motor of the suction-removal mechanism is kept constant so that the power of the auxiliary electric motor remains substantially the same irrespective of voltage changes in the voltage supply. Therefore, the quality of the result of the work is advantageously not subject to any fluctuations for the user of the electric appliance.

Power tools and/or electric appliances which can be used in a flexible manner are often operated with a supply voltage from a mobile energy storage device in the form of a rechargeable battery. The auxiliary electric load, that is to say the operating area illumination mechanism for example, can be supplied with auxiliary voltage from the mobile energy storage device in a simple manner by means of a pulse-width modulation signal which is fed by the voltage supply. The pulse-width modulation signal is adjusted depending upon the power status of the voltage supply so that the auxiliary voltage supplied to the auxiliary electric load is substantially constant.

This measure is advantageously used to control the brightness of the lighting source for the operating area illumination mechanism as a function of the voltage supply. This means that, when the rechargeable battery is discharged, the corresponding voltage drop is detected and the lighting source is subsequently supplied with more energy in order to generate the same brightness. Furthermore, the same operating area illumination mechanism can also be used in power tools which are operated at different voltages with different rechargeable batteries, with the operating area illumination mechanism nevertheless having the same brightness. The result is more consistent performance of the auxiliary electric load since it is unnecessary to alter the auxiliary load when a rechargeable battery with a greater voltage is used. In addition, it is economically advantageous to be able to use a more favorable and therefore less luminous lighting source.

The electric appliance may customarily have a switch which has a switch housing. Operation of the electric appliance can be switched on and/or switched off with the aid of the switch. In the case of a power tool, a power tool switch is provided, for example, in the handle for this purpose. With a compact construction, it is possible for the pulse-width modulation signal to be generated by an electronics system which is located in the switch housing. The pulse-width modulation signal can additionally be switched on and/or switched off by the electronics system, in order to automatically connect and/or disconnect the operating area illumination mechanism in a simple manner. A microcontroller or microprocessor which is preferably correspondingly controlled by means of software can be expediently used as the electronics system. If desired, the pulse-width modulation signal for the operating area illumination mechanism or another auxiliary electric load can also be switched on and/or switched off manually by the user by means of a mechanical switch, for example a switch-on contact. The mechanical switch is arranged at a suitable, easily accessible point on the electric appliance or on the power tool.

A further additional functionality is achieved in that communication with an external appliance is possible directly and/or indirectly by means of optical transmission using the controlled operating area illumination mechanism. To this end, data which corresponds to the pulse-width modulation signal for the operating area illumination mechanism can be modulated on with little outlay. This increase in functionality is achieved substantially without additional costs.

In a preferred embodiment, the electronics system of the power tool switch can be supplied with electrical energy by a connected mobile energy storage device, for example by a rechargeable battery with a nominal voltage of 14.4 V DC, 18.0 V DC or another expedient voltage.

The operating area illumination mechanism is always supplied with the same amount of energy by the energy storage device used, irrespective of the absolute voltage and charge state of the energy storage device. To this end, the electronics system of the power tool switch generates a pulse-width modulation (PWM) signal which is set as a function of the voltage supply and additionally can be switched off. The required PWM signal can be generated by means of a microcontroller. The PWM signal can be switched off by means of the microcontroller or a mechanical switch, for example a switch-on contact.

It is advantageous here for the hardware to be designed such that this function does not require any equipment variants. No different series resistors are required for limiting the current in different rechargeable batteries with different voltages. If a microcontroller is used, the software can control the operating area illumination mechanism in such a way that the operating area illumination mechanism does not cause total discharge of the energy storage device. As already mentioned, a corresponding actuator can be used instead of or in addition to the operating area illumination mechanism according to the invention, even when different types of auxiliary electric loads are used. For example, a controller of this type can also be used for the drill dust suction-removal mechanism. Finally, this device can also be used to communicate with the auxiliary electric load or even an external appliance directly and/or indirectly, for example by means of optical transmission.

The advantages achieved by the invention are, in particular, that electronics modules for power tools or other electric appliances can be produced, these electronics modules being independent of the operating voltage. When a microcontroller is used, the software can control the desired behavior of the electronics system and of the operating area illumination mechanism. The same electronics module can be used for a plurality of different voltage variants, with the behavior which is dependent on the supply voltage first being determined by the software. Therefore, costs are also saved with regard to production of the power tool switch. In addition, the energy losses in the switched-off state are minimal, this resulting in an energy saving and/or preventing total discharge of the mobile energy storage device, this total discharge impairing the functionality.

BRIEF DESCRIPTION OF THE DRAWING

An exemplary embodiment of the invention with various developments and refinements will be described in greater detail in the text which follows and is illustrated in the drawing.

The FIGURE schematically shows a power tool with an operating area illumination mechanism and a drill dust suction-removal mechanism, with the housing of the power tool being illustrated in a partially broken-away fashion.

DETAILED DESCRIPTION OF THE INVENTION

The FIGURE shows a power tool 1 with an electric motor 2 for driving a tool 3. The tool may be a rechargeable battery-powered and/or plug-powered power tool. By way of example, the FIGURE shows a rechargeable battery-operated drill as power tool 1, which drill is operated with a voltage supply from a mobile energy storage device 8 in the form of a rechargeable battery. It goes without saying that the power tool 1 may also be a grinder, a saw, a plane, an angle grinder or the like.

A switch 5 with a switch housing 13 is arranged in the housing 4 of the power tool 1. The switch 5 is accommodated in the housing 4 in such a way that an operating element 6 of the switch 5, which operating element can be moved manually by the user, projects out of the housing 4. The switch 5 has a contact system 7 which is acted on by the operating element 6 for switching over purposes, so that the voltage supply from the energy storage device 8 for the power tool 1, specifically for operating the electric motor 2 in particular, can be switched on and/or switched off by the user by means of the operating element 6. Finally, the switch 5 comprises an electric circuit arrangement for controlling and/or regulating the electric motor 2. The circuit arrangement serves as the control electronics system 9 for changing the rotation speed of the electric motor 2 in accordance with the position of the operating element 6 moved by the user. The control electronics system 9 is expediently located in the switch housing 13.

An operating area illumination mechanism 10, with the aid of which the operating region for the tool 3 can be illuminated in order to assist the user, is arranged on the housing 4 as an additional function for the power tool 1. The operating area illumination mechanism 10 is likewise supplied with an auxiliary voltage which is generated by the energy storage device 8. The voltage in the energy storage device 8 can vary depending on its charge state and also fluctuate for other reasons. So that the brightness of the operating area illumination mechanism 10 remains substantially the same irrespective of fluctuations in the voltage supply from the energy storage device 8, the auxiliary voltage supplied to the operating area illumination mechanism 10 is kept constant.

The operating area illumination mechanism 10 is supplied with voltage by means of the control electronics system 9 which operates as a pulse-width modulation circuit. The operating area illumination mechanism 10 is therefore operated by means of a pulse-width modulation signal 11 which is provided by the supply voltage from the energy storage device 8. The pulse-width modulation signal 11 is adjusted depending upon the power status of the supply voltage from the energy storage device 8 in such a way that the auxiliary voltage supplied to the operating area illumination mechanism 10 is substantially constant. For example, if the actual voltage of the voltage supply decreases, then the length of the pulse-width signal supplied to the auxiliary electric load will be enlarged in order to provide the correct auxiliary voltage. On the other hand, if an operating area illumination mechanism 10 uses an LED-lamp that needs a voltage of 6V and the actual voltage of the voltage supply is 8V, then the pulse-width modulation will be decreased in order to provide only 6V to the LED. As a result, the operating area illumination mechanism 10 will always light up with the same brightness and substantially without fluctuations.

The pulse-width modulation signal 11 is generated by an electronics system in the power tool switch 5, with the electronics system being the control electronics system 9, as already mentioned. In addition, the pulse-width modulation signal 11 can be switched on and/or switched off by the electronics system 9, whereby the operating area illumination mechanism 10 is connected or else disconnected by means of the electronics system 9, for example when the user operates the operating element 6. It goes without saying that the electronics system 9 can also be switched off with a time delay, this causing the operating region to be illuminated even after the power tool 1 has already been switched off. The electronics system 9 used may be, in a simple form, a microprocessor or a microcontroller which is correspondingly controlled by means of software.

The pulse-width modulation signal 11 for the operating illumination mechanism 10 can also be switched on and/or switched off by means of an electromechanical switch, for example a switch-on contact 12, instead of by means of the electronics system 9. The switch-on contact 12 schematically shown in the FIGURE is in the form of a key in the present case and is arranged at a point on the housing 4 which can be easily operated by the user.

The power tool 1 has the further function of a suction-removal mechanism 14 for the drill dust which is produced in the operating area. The drill dust suction-removal mechanism 14 is arranged on the housing 4 in the vicinity of the tool 3 and operates by means of an auxiliary electric motor 15. The motor 15 is in turn operated by the electronics system 9 by means of the pulse-width modulation signal 11 from the energy storage device 8. As a result, the auxiliary voltage supplied to the motor 15 of the drill dust suction-removal mechanism 14 is kept constant, as a result of which the power of the motor 15 remains substantially the same irrespective of voltage changes in the voltage supply. Consistently steady suction-removal of the drill dust produced is therefore ensured. It is also possible here to switch on the drill dust suction-removal mechanism 14 by means of the electronics system 9 when the user operates the power tool switch 5 by means of the operating element 6.

Finally, communication with an external appliance directly and/or indirectly by means of optical transmission can additionally be made possible by means of the operating area illumination mechanism 10 controlled by the electronic system 9 since the data to be transmitted is correspondingly modulated onto the pulse-width modulation signal 11. In this case, the modulated signal creates brightness fluctuations in the operating area illumination mechanism 10 which are not visible to the human eye.

The invention is explained with reference to a power tool 1, but is not restricted to the exemplary embodiment described and illustrated. Rather, said invention covers all developments made by a person skilled in the art within the scope of the invention defined by the patent claims. Therefore, an operating area illumination mechanism, which is operated with a constant auxiliary voltage supply and remains substantially the same, and/or an auxiliary electric load, which is operated with a constant auxiliary voltage supply, for an additional function can also be used on other electric appliances, for example on domestic appliances, on portable lamps or the like.

LIST OF REFERENCE SYMBOLS

1: Power tool
2: Electric motor
3: Tool
4: Housing (of power tool)
5: Switch/Power tool switch
6: Operating element
7: Contact system
8: Energy storage device
9: Control electronics systems/Electronics system
10: Operating area illumination mechanism
11: Pulse-width modulation signal
12: Switch-on contact
13: Switch housing
14: Suction-removal mechanism
15: Motor for 14

Patent claims:

1. An electric appliance having a main electric load, an auxiliary electric load, and a voltage supply for operating both electric loads, wherein an auxiliary voltage is generated by the voltage supply and supplied to the auxiliary electric load at a constant level so that the power of the auxiliary electric load remains substantially the same irrespective of voltage fluctuations in the voltage supply, wherein the voltage supply is a rechargeable battery, and the auxiliary electric load is supplied with auxiliary voltage in the form of a pulse-width modulation signal that is fed by the rechargeable battery, and the pulse-width modulation signal is controlled so that the auxiliary voltage supplied to the auxiliary electric load is substantially constant.

2. The electric appliance according to claim 1, wherein said electric appliance is a power tool with an electric motor.

3. The electric appliance according to claim 2, wherein the power tool is at least one of a rechargeable battery-powered and plug-powered power tool.

4. The electric appliance according to claim 2, wherein the power tool in one of a drill, grinder, saw, plane, and angle grinder.

5. The electric appliance according to claim 1, wherein said electric appliance is a domestic appliance with an electric motor.

6. The electric appliance according to claim 1, wherein said electric appliance is a portable lamp.

7. The electric appliance according to claim 1, wherein said auxiliary electric load comprises an operating area illumination mechanism, and the auxiliary voltage supplied to the operating area illumination mechanism is kept constant so that the brightness of the operating area illumination mechanism remains substantially the same irrespective of voltage fluctuations in the voltage supply.

8. The electric appliance according to claim 7, wherein the operating area illumination mechanism transmits optical signals containing data to communicate with an external appliance.

9. The electric appliance according to claim 8, wherein data to be transmitted is modulated onto the pulse-width modulation signal of the auxiliary voltage.

10. The electric appliance according to claim 1, wherein said auxiliary electric load comprises a suction-removal mechanism, which operates by means of a motor, for an operating area of the electric appliance, and the auxiliary voltage supplied to the motor is kept constant so that the power of the motor remains substantially the same irrespective of voltage fluctuations in the voltage supply.

11. The electric appliance according to claim 1, further comprising a switch to turn the electric appliance on and off, wherein the switch has a switch housing and an electronics system located in the switch housing.

12. The electric appliance according to claim 1, wherein said pulse-width modulation signal is switched on and off by a mechanical switch.

13. The electric appliance according to claim 12, wherein the mechanical switch is a switch-on contact.

14. The electric appliance according to claim 1, wherein the pulse-width modulation signal is generated by the electronics system.

15. The electric appliance according to claim 14, wherein the pulse-width modulation signal is switched on and off by the electronics system.

16. The electric appliance according to claim 15, wherein the electronics system includes a microcontroller which is controlled by software.

17. An electric appliance comprising a housing, a main electric load, an auxiliary electric load, and a voltage supply for operating the main electric load and the auxiliary electric load, wherein the main electric load and the auxiliary electric load are contained within the housing of the electric appliance, wherein the voltage supply generates an auxiliary voltage that is supplied to the auxiliary electric load at a constant level so that the power of the auxiliary electric load remains substantially the same irrespective of voltage fluctuations in the voltage supply, and wherein the voltage supply is a rechargeable battery, and the auxiliary electric load is supplied with auxiliary voltage in the form of a pulse-width modulation signal that is fed by the rechargeable battery, and the pulse-width modulation signal is controlled so that the auxiliary voltage supplied to the auxiliary electric load is substantially constant.

* * * * *